US006224811B1

(12) United States Patent
Powers et al.

(10) Patent No.: US 6,224,811 B1
(45) Date of Patent: May 1, 2001

(54) THERMAL BONDING OF WET CELLULOSE BASED FIBERS

(75) Inventors: Edward J. Powers, Charlotte, NC (US); Harold W. Davis, Gaffney, SC (US); James Robert Walden, Matthews, NC (US)

(73) Assignee: Celanese Acetate LLC, Charlotte, NC (US)

( * ) Notice: Subject to any disclaimer, the term of this patent is extended or adjusted under 35 U.S.C. 154(b) by 0 days.

(21) Appl. No.: 09/240,073

(22) Filed: Jan. 29, 1999

(51) Int. Cl.[7] ..... B29C 43/24; B29C 71/00
(52) U.S. Cl. ..... 264/280
(58) Field of Search ..... 264/280

(56) References Cited

U.S. PATENT DOCUMENTS

| | | | | |
|---|---|---|---|---|
| 2,277,049 | | 3/1942 | Reed . | |
| 2,673,163 | | 3/1954 | Rohm . | |
| 2,692,420 | | 10/1954 | Bamber et al. . | |
| 3,096,557 | * | 7/1963 | Messinger | 264/280 X |
| 5,783,505 | | 7/1998 | Duckett et al. . | |

OTHER PUBLICATIONS

Encyclopedia of Polymer Science and Engineering, a Wiley-Interscience Publication, New York, 1986 vol. 2 pp. 606–622 Ibid, vol. 6, pp 639–640.

Encyclopedia of Polymer Science & Engineering, vol. 6 (1986), pp. 639–640.

Encyclopedia of Polymer Science & Engineering, vol. 6 (1986), pp. 699–701.

* cited by examiner

*Primary Examiner*—Leo B. Tentoni
(74) *Attorney, Agent, or Firm*—Walter M. Douglas

(57) ABSTRACT

The disclosure disclosed a fabric made of cellulose acetate and/or cellulose triacetate, and optionally fibers of other selected substances, which are calendered at selected temperatures and pressures after having been water-wetted to a selected water content in order to bond the fibers of cellulose acetate and/or triacetate to one another and/or to fibers of the other selected substances. The selected calendering temperatures are from about 130° C. to about 210° C., preferably from about 160° C. to about 190° C.; the selected pressures are from about 500 to about 5000 psi, preferably from about 500 to about 2500 psi and most preferably from about 1000 to about 2500 psi; and selected water content is from about 20% to about 600% of fabric dry weight. The physical properties of the calendered fabric, for example the stiffness or hand resulting from different degrees of bonding can be changed by altering one or more of there parameters, either separately or in combination. The physical properties can also be changed by changed by changing the rate at which the fabric is passed between the calendering rollers or the type of rollers used, for example, smooth versus embossed or patterned rollers.

43 Claims, 4 Drawing Sheets

THERMAL BONDING OF WET CELLULOSE BASED FIBERS

FIELD OF THE INVENTION

This invention relates to the thermal bonding of fibers in fabrics and webs fibers, and in particular to the thermal bonding of fibers in fabrics or webs made of cellulose esters, cellulose ethers, or mixtures of fibers made of cellulose esters and/or ethers and fibers made of other substances. Cellulose esters is particular interest are cellulose acetate and cellulose triacetate.

BACKGROUND OF THE INVENTION

Fabrics or fiber webs made of or containing cellulose esters and/or ethers, and in particular cellulose acetate and cellulose triacetate, (all the foregoing hereinafter collectively called CA) can undergo a thermal bonding treatment to thereby cause the CA fibers of the fabric or web to bond to one another and/or to other fibers in the fabric or web. In addition, when two or more layers of a CA containing fabric or web need to be "joined" or "bonded", such layers can be bonded together by a thermal process known in the art as "calendering". Generally, such calendering processes are carried out on material having a low moisture content. The calendering process is performed by passing the fabric or web between a pair of rollers which exert a pressure on the fabric. Typically, one or both of the rollers is heated to a selected temperature to accomplish the calendering. A calendering process for applying a coating to a fabric is described in the *Encyclopedia of Polymer Science and Engineering*, Vol. 6 (Wiley-Interscience, John Wiley & Sons, New York 1986), pages 639–640 and ibid., Vol. 2, pages 606–622. A calendering process to bond fibers of a material to one another and/or to fibers made of other materials are carried out in a similar manner using calender rollers heated to a selected temperature appropriate for the fiber(s) to be bonded. In the calendering process, the combination of the temperature and the pressure exerted by the rollers causes the fibers to soften and/or melt, and to bond to themselves or to other fibers in the fabric or material being calendered.

Many natural and artificial fibers show little tendency to bond with the application of heat, or require such high temperatures for bonding that a fabric made of such fibers is detrimentally effected if calendering is attempted. For example, fabrics made of cellulose acetate must typically be calendered at a temperature of about 220° C., or higher, in order to effect fiber bonding. For example, U.S. Pat. No. 2,277,049 disclosed a calendering temperature of 232° C. (450° F. at page 3, left column, line 68). However, at these temperatures, the fibers may be degraded with impairment of fabric quality (e.g., discoloration, strength degradation, fiber embrittlement and similar impairments). For example, cellulose acetate fabrics may be used in apparel where their draping qualities are desired. Embrittlement of the fibers stiffens the fabric and the draping quality is lost. In addition, high temperature bonding results in greater energy costs, bonding non-uniformity from roller distortion, and imposes high machinery maintenance costs, for example, seals, bearings, roller distortion caused bowing of the rollers at their center due to the heats required which results in the need for more frequent roller replacement, and similar items.

A number of patents describe methods which have been used in various processes to improve the bonding of cellulosic fibers. U.S. Pat. No. 2,692,420 to Bamber et al. (Bamber) describes the production of felts from a combination of (1) wool or other animal fibers capable of felting and (2) cellulose acetate fibers. Banber recites the difficulty encountered in preparing such felts and teaches treating such felt mixtures with organic softening agents to soften the cellulose acetate fibers before felting, and thereby facilitating the felting process.

U.S. Pat. No. 2,277,049 to Reed (cited above), in addition to disclosing a calendering temperature of 232° C., also discloses the use of various organic solvents to soften binding fibers in a fabric which is a mixture of binding fibers and cotton. Reed finds the use of such solvents is objectionable. Additionally, Reed also discloses water wetting a fabric that has been heat calendered in order to soften the still calendered fabric. This water wetting is post-calendering and does not influence the calendering temperature employed.

U.S. Pat. No. 5,783,39 to Duckett et al describes the use of acetone vapor to lower the softening temperature of cellulose acetate fibers in order to lower calendering temperature. While lower bonding temperatures may be achieved using the method of Duckett et al., the use of acetone vapors creates a fire and explosive hazard which is not desirable in commercial operations.

U.S. Pat. No. 2,673,163 to Rohm describes adding water to bulk cellulose esters such as cellulose acetate flake in order to lower the melting point of the ester prior to extruding it through an orifice such as in a melt spinning process. The amount of water incorporated in the molten mass is above the normal "regain" moisture of the dry ester, typically in the range of 0.5–10%. "The preferred moisture content is at 8–9% with a hydrolyzed cellulose acetate derivative, and at about 6% with cellulose triacetate." (See Rohm, column 2, lines 2–5.)

Cellulose acetate fibers are known to bond at temperatures of about 220° C. The use of organic softening agents such as described by Bamber can lower this temperature, but the use of such organic substances with acetate fabric is undesirable from worker safety, both economic and environmental considerations. Other than through the use of organic chemical plasticizers, the art generally does not teach a satisfactory method of reducing the temperature at which cellulose acetate or cellulose triacetate fibers can be bonded to one another in a fabric or to fibers of other materials which may be present in a fabric or web. In the present invention, water is acting as a plasticizer.

Accordingly, it is an object of this invention to provide a process whereby the temperature required to bond cellulose ester and cellulose ether fibers to one another or to fibers of other materials present in a fabric or web can be reduced.

It is a further object of this invention to provide a process using water to reduce the temperature required to bond cellulose ether and cellulose ester fibers to one another or to fibers of other materials present in a fabric or web.

It is an additional object of this invention to provide a process whereby calendering a fabric or a web containing fibers of a cellulose ester or a cellulose ether at selected temperatures and in the presence of a selected amount water will cause the cellulose ester/ether fibers to bond to one another or to fibers made of other materials at temperatures less than 220° C.; and will further impart a range of physical characteristics to the calendered fabric, for example, "hand " or "stiffness".

SUMMARY OF THE INVENTION

The invention discloses a process for bonding fabric and web fibers of cellulose esters and/or cellulose ethers to one another and/or to fibers made of other selected substances which may be present in the fabric or web. In the process the fabric or web is water wetted and passed between at least one pair and optionally a plurality of pairs of calendering rollers which are heated to a temperature of from about 130° C. to about 210° C., preferably from about 150° C. to about 190° C., said rollers also exerting a pressure on the fabric of from about 20 to about 5000 psi, preferably from about 50 to about 1000 psi. The water content of the wetted fabric is from about 20% to about 600% of the fabric dry weight. Material may be passed between the calendering rollers at any commercially viable rate of speed. typically, this speed is from about 0.5 to about 200 meters per minute.

The fibers of the other selected substances present in the fabric may be selected from the group consisting of cellulose fibers from wood pulp, flax and similar natural products, rayon, polyesters, wool, cotton, silk, polyamides, polyacrylates, polymethacrylates, polyolefins and similar polymers known to those skilled in the art which are appropriate for blending with fibers of cellulose acetate and/or cellulose triacetate. The quantity of such other fibers in the fabric may be from about 1% to about 90% of the total weight of the fabric.

DETAILED DESCRIPTION OF THE INVENTION

Figure 1:
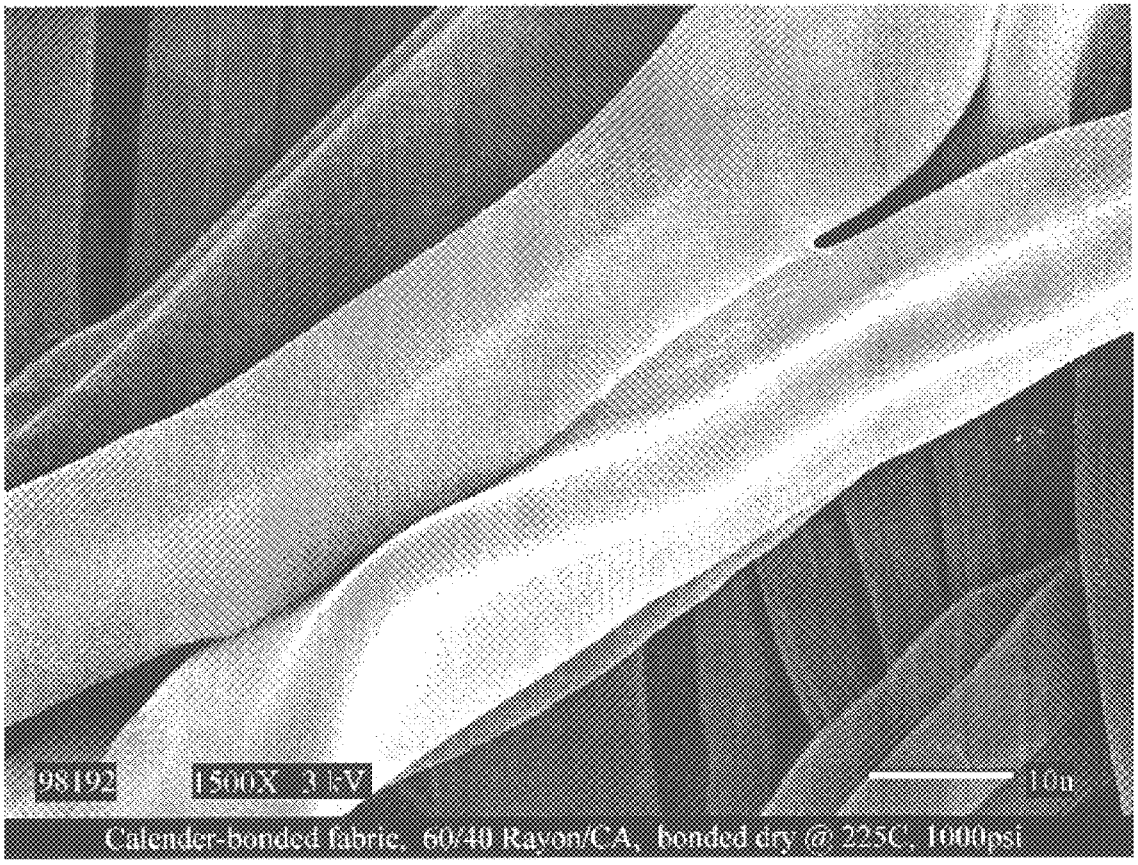
FIG. 1 illustrates the type of discrete bond formed between two cellulose acetate fibers or between a cellulose acetate fiber and a rayon fiber when calendered at 225° C. and a pressure of 1000 psi without water treatment in accordance with the invention.

As used herein, the terms "cellulose acetate", "acetate" and "CA" means a cellulose ester or ether wherein either the acid portion of the ester or the "ethereal" portion of the cellulose ether is an alkane or alkene moiety of five or less carbon atoms and the degree of substitution of the ester/ether groups for cellulose hydroxyl groups is from about 2.2 to about 2.65, a value of 3.0 being the theoretical maximum. The term "cellulose triacetate" or "triacetate" signifies a degree of substitution of from about 2.65 to 3.0. Examples of the alkanoic and alkenoic acids include propanoic, butanoic, butenoic, isopropanoic, isopropenoic, pentanoic, neopentanoic, formic, acetic and similar acids. Examples of the ethereal groups which may form the cellulose ether include methyl, ethyl, propyl, isopropyl, butyl, isopropenyl, butenyl, pentyl, neopentyl, pentenyl and similar $C_5$ or lower groups, said groups replacing the cellulose hydroxyl hydrogens. Both cellulose acetate and cellulose triacetate, alone or in combination with one other or with fibers of other selected material, may be used in the process of the invention.

As described herein, the wet calendering process of the invention can be use with fabrics and webs made of cellulose esters and ethers, and includes fabrics made of mixtures of cellulose esters/ethers and mixtures of such cellulose esters/ethers with fibers made from other substances. Examples of fiber made from other selected substances include fibers made from natural products (e.g., wood pulp, cotton, silk, wool and similar fibers), polyolefins, polyesters, rayon and polyamides. Preferred cellulose esters/ethers are cellulose acetate and triacetate.

All percentages herein are by weight unless otherwise stated.

The terms "fabric" and "material", when used in connection with calendering process of the invention, may be used interchangeably herein. The terms denote a fabric or material containing fibers of cellulose esters/ethers, either alone or in combination with one another, or with fibers made of other selected substances as described herein. Preferred cellulose esters/ethers are cellulose acetate and triacetate.

"Fabric" as used herein can be woven, knitted or non-woven, such non-woven fabrics denoting webs of fibers which may have been calendered by methods other than those of this invention or which have been in which the fibers have been entangled or bonded by hydroentanglement, resin bonding, needle punching and similar methods known to those skilled in the art. "Fabric" further includes non-woven webs of fibers in which the fibers have not been entangled or bonded by methods known in the art.

The calendering rollers used in practicing the invention are heated rollers and can have either a smooth surface, or an embossed or patterned surface. For example, both rollers may have smooth surfaces, one can be smooth and one embossed, and both can be embossed. The rollers can be heated to the selected temperature by any means known in the art. For example, electrically or by passing a heated fluid through the rollers. Temperatures employed to accomplish the bonding of cellulose esters/ethers in accordance with the invention, for example, the cellulose acetate or cellulose triacetate fibers used in the examples herein, range from about 130° C. to about 210° C., preferably from about 150° C. to about 190° C.

As the data contained in Tables 1–5 will show, calendering temperature and pressure, and the amount of water in the material being calendered will all effect the degree of bonding which is obtained. In addition, the speed at which the material is passed through the calendering rollers will also effect the degree of bonding, the faster the speed the lower the degree of bonding obtained. In practicing the invention the calendering temperature may range from about 130° C. to about 210° C., preferably from about 150° C. to 190° C. The water content in the fabric or material being calendered can vary from about 20% to about 600% of the material weight based on the weight of the dry material. The pressured exerted by the calendering rollers on the material may range from about 20 to about 5000 psi, preferably from about 50 to about 1000 psi. The rate at which the material passes through the calendering rollers may range from about 0.5 to 200 meters per minutes, preferably from about 25 to about 150 meters per minute. The exact combination of temperature, pressure, water content and material speed may readily be varied by one skilled in the art to achieve a material having a selected set of physical characteristics such as strength, density, stiffness and degree of fiber bonding. One skilled in the art will also be readily able to see that it is possible to achieve a given set of characteristics under different sets of conditions. For example, at a specified material speed and roller pressure, a specified degree of fiber bonding and resulting material strength could be achieved by varying the temperature and water content of the material.

The materials which can be calendered according to the process of the invention can be any assembly of fibers: woven, non-woven, web, knitted or similar material containing cellulose esters/ethers. Thus materials made of cellulose esters/ethers alone, or cellulose esters/ethers blended with other materials such as natural product fibers, rayon, polyolefins, polyesters, polyamides, polyacrylates, polymethacrylates and liquid crystalline polymers and similar polymeric materials known to those skilled in the can used in practicing the invention. Particularly preferred, in addition to materials made of cellulose esters/ethers, are blends containing polyesters, polyolefins, polyacrylates, polymethacrylates, cotton, wool, silk, wood pulp, cellulose fibers such as flax and similar substances.

The following examples are given to illustrate the invention and are not intended to be limiting. The use of cellulose acetate or triacetate in the examples should be understood to mean cellulose esters/ethers generally as described herein. In the examples herein, sheets of fiber webs were fed to a laboratory scale calendering apparatus. The fiber webs were prepared on carding machines, Rando web machines or were wet-laid on a hand-sheet former. The pressures utilized in these laboratory experiments, 500 to 5000 psi, is recognized as being higher than those which will be used in typical large scale commercial equipment. Such large scale commercial equipment typically used calendering pressures of about 10 or 20 psi to about 2000 psi, preferably about 50 to about 1000 psi. Material is fed to such commercial equipment at rated from about 0.5 to about 200 meters per minute, or higher, preferably from about 25 to about 150 meters per minute.

EXAMPLE 1

Example 1 was carried out using 3 osy (ounce per square yard) random dry laid webs of 60% rayon and 40% CA. The rayon and CA fibers used in forming the web were 1½ inch trilobal fibers of 1.5 and 1.7 dpf (denier per filament), respectively. Calender bonding was performed at the temperatures and pressures given in Table 1 with the web passing through the rollers at the rate of one (1) meter per minute. No water was added to the web. Bonding temperature is in degrees Centigrade. Bonding Pressure is in psi. Peak load is in lb/inch and measures the force required to break a one (1) inch strip of fabric. Strain at break is in percentage and measures the amount that a strip of fabric extends or stretches before it breaks. High Peak Loads and Strain at Break are desirable. It is desirable to obtain such values at the lowest possible bonding temperatures and bonding pressures.

TABLE 1

| Bonding Temperature | Bonding | Tensile Properties | |
|---|---|---|---|
| ° C. | Pressure psi | Peak Load[1] | Strain at Break[2] |
| 230 | 2500 | 8.5 | 8.2 |
| 230 | 1000 | 4.9 | 3.4 |
| 225 | 2500 | 7.5 | 6.9 |
| 225 | 1000 | 4.7 | 4.2 |
| 220 | 2500 | 3.6 | 5.7 |
| 220 | 1000 | 0.8 | 9.7 |
| 210 | 2500 | 1.5 | 5.2 |
| 210 | 1000 | 0.6 | 3.9 |

Notes:
[1]Peak load is in pounds per inch.
[2]Strain at Break is as percentage (%).

The data in Table 1 illustrates the tensile properties of webs of unattached rayon and cellulose acetate fibers which have been calendered, without the addition of added water as taught by the invention, between smooth rollers at the temperatures and pressures indicated. The rayon/CA web bonded in Table 1 were "dry", that is, they contained a regain, equilibrium moisture content of about 6%. At bonding temperatures of 230° C. and higher pressures, webs containing CA are converted into structures of appreciable strength as indicated by the Peak Load and Strain at Break values. At temperatures greater than 230° C. even stronger structures can be formed, but such higher temperatures can lead to discoloration of the materials.

FIG. 1 illustrates the type of discrete bonding that can be formed between two CA fibers or a CA fiber and a rayon fiber when bonded at 225° C. and a pressure of 1000 psi as in Table 1. It is noted that when smooth calender rollers are used as in these examples, stronger, tougher webs are formed from blends of bonding/non-bonding fibers (e.g., CA/rayon) then when the webs are made of 100% bonding fiber. With smooth calender rollers, 100% bonding fibers can become over bonded resulting in very stiff fabrics (materials) or can even be converted from a fibrous structure into a film-like sheet. Calender rollers with a bonding pattern, the so-called embossed rollers, are often used with webs of 100% bonding fibers, and also with blends of bonding/non-bonding fibers, to obtain structures with a balance of properties that are different from those obtained with smooth rollers. There are many type of bonding patterns known in the art and any of these can be with the invention. The different bonding patterns have a wide range of bonding areas.

Figure 2:
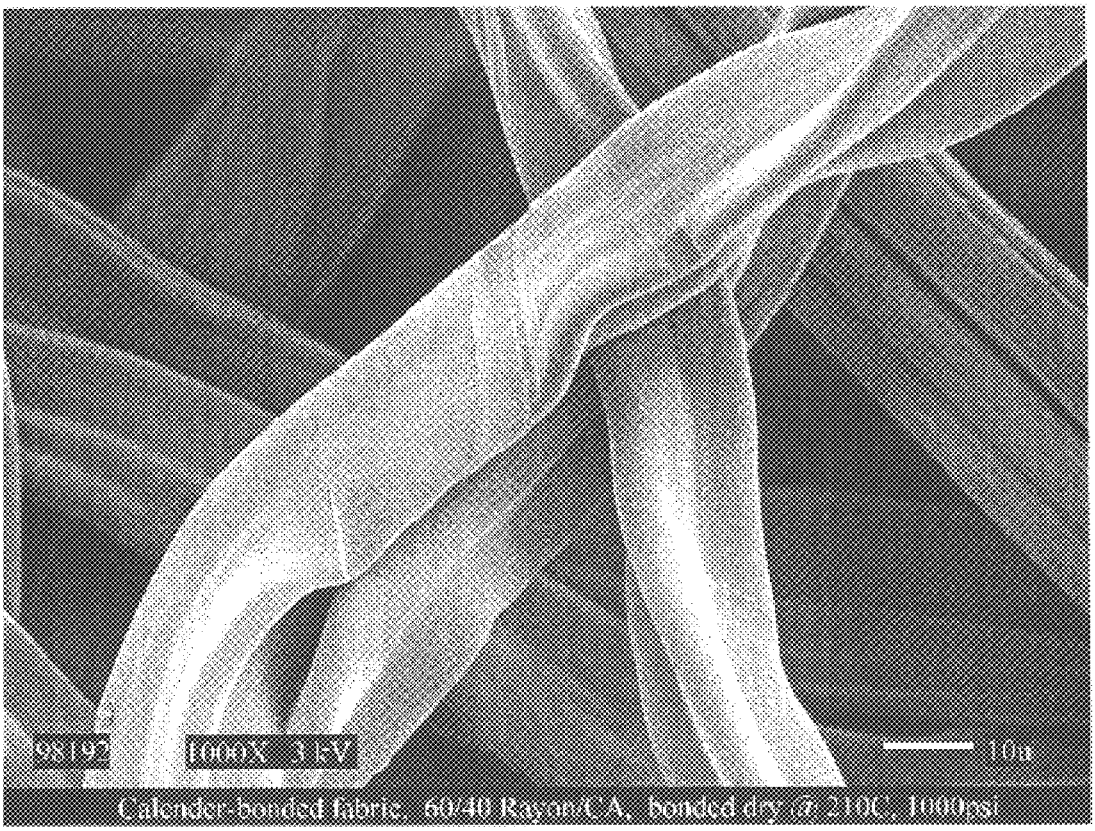
FIG. 2 illustrates the lack of discrete bonding which occurs when the material of FIG. 1 is calendered at a lower temperature of 210° C. and a pressure of 1000 psi without the wetting taught by the invention.

FIG. 2, also based on webs bonded according to the conditions of Table 1, illustrate the calendering of "dry" CA containing webs at less severe conditions, for example, a temperature of 210° C. and 1000 psi. FIG. 2 shows that under these conditions, "dry" CA fibers deform and form some tack bonds, but the discrete bonds such as are shown in FIG. 1 are not formed. The data in FIG. 2 thus illustrates that when "dry" CA fibers are calendered, temperatures in excess for 210° C. are required for good bond formation.

EXAMPLE 2

Example 2 was carried out to measure the tensile properties of 3 osy cross-lapped card webs of a blend of 80% rayon and 20% cellulose acetate, 1½ inch trilobal fibers which were dipped in water for one minute, vacuum extracted to remove excess water and calendered between smooth rollers. Web material was passed between the rollers at a rate of one meter per minute at the temperatures and pressures specified in Table 2. The water content of the web at calendering varied from less than 200% to greater than 600% of the dry web weight.

TABLE 2

| Sample | Bonding Temp. Temp, ° C. | Bonding Pressure psi | Tensile Properties Peak Load[1] | Strain at Break[2] |
|---|---|---|---|---|
| No Water Water[3] | 190 | 2000 | 0.12 | 62.8 |
| 1 | 190 | 2000 | 11.9 | 10.4 |
| 2 | 190 | 1000 | 12.2 | 11.1 |
| 3 | 190 | 500 | 4.7 | 18.5 |
| 4 | 175 | 2000 | 11.9 | 10.8 |
| 5 | 175 | 1000 | 6.3 | 17.1 |
| 6 | 175 | 500 | 0.5 | 12.3 |
| 7 | 160 | 2000 | 10.3 | 14.4 |
| 8 | 160 | 1000 | 2.9 | 26.2 |
| 9 | 160 | 500 | 0.32 | 21.9 |

Notes:
[1]Peak load is in pounds per inch.
[2]Strain at Break is as percentage (%).
[3]Water added as described above.

The results shown in Table 2 indicate that webs containing CA which also contain water above the equilibrium regain amount, about 6%, may be converted into strong structures at much lower temperatures than webs which contain only the equilibrium amount of water. The data in Table 2 indicates that at 190° C., webs containing CA and rayon with no added water had low tensile strength. For example, a web calendered at 190° C. and 2000 psi with no added water has a peak load strength of only 0.12 lb/in. In contrast, if the web is water treated and vacuum extracted to remove excess water before calendering, a structure is formed which has a strength almost two orders of magnitude higher than that of the non-wetted web. (Compare the first two webs listed in Table 2.) Generally, the data indicates that all water-treated webs, calendered at temperatures between 160–190° C. and pressures of 500–2000 psi had higher peak load strength than the non-wetted web. The data thus also indicates that wet calendering can achieve a more strongly bonded web at lower temperatures and pressures. The data also indicates that as for the non-wetted webs, at a given calendering temperature, higher calendering pressures result in stronger structures.

EXAMPLE 3

Example 3 was carried out to measure the tensile properties of 3 osy random, dry laid webs of a blend of 1½ inch fibers of 1.5 dpf rayon and 1.7 dpf cellulose acetate that were dipped in water, vacuum extracted to remove excess water and calendered between smooth rollers at the temperatures and pressures specified in Table 3. Web material passed between the rollers at a rate of one meter per minute. "None added" signified that the web was not dipped and the moisture content was the normal regain moisture content. Fiber webs of varying size were weighed before dipping in water and after vacuum extraction to determine the water content of the web.

TABLE 3

| Web $H_2O$ Content (%) | Calender Temp., ° C. | Calender Press., psi | Calendered Web Thick., in. | Peak Load[1] | Strain at Break[2] |
|---|---|---|---|---|---|
| | A. | 80/20 Rayon/CA Web | | | |
| None added | 170 | 1000 | 0.0273 | 0.3 | 32 |
| 452 | 170 | 1000 | 0.0091 | 10.6 | 7.4 |
| 516 | 160 | 1000 | 0.0158 | 2.4 | 5.5 |
| 267 | 150 | 1000 | 0.0113 | 4.8 | 4.4 |
| 259 | 140 | 1000 | 0.0312 | 0.5 | 14.8 |
| 291 | 130 | 1000 | 0.0419 | 0.5 | 21.3 |
| 222 | 120 | 1000 | 0.0530 | 0.3 | 32 |
| | B. | 60/40 Rayon/CA Web | | | |
| None added | 170 | 1000 | 0.0292 | 0.3 | 26.8 |
| 431 | 170 | 1000 | 0.0087 | 19.4 | 7.5 |
| 509 | 160 | 1000 | 0.0248 | 1.4 | 7.8 |
| 211 | 150 | 1000 | 0.0129 | 4.8 | 2.9 |
| 278 | 140 | 1000 | 0.0236 | 1 | 9.0 |
| 260 | 130 | 1000 | 0.0362 | 0.5 | 25.4 |
| 393 | 120 | 1000 | 0.0399 | 0.4 | 21.3 |

Notes:
[1]Peak load is in pounds per inch.
[2]Strain at Break is as percentage (%).

The data in Table 3 indicates that strong structures are formed from webs containing CA at temperatures as low as 150° C. At higher calendering pressures, it is believed likely that strong structures can also be formed at temperatures below 150° C. For example, it is believed that at a temperature of 130° C. and a pressure of 3000–5000 psi a structure can be formed with the strength of a web calendered at 170° C. and 1000 psi.

Figure 3:
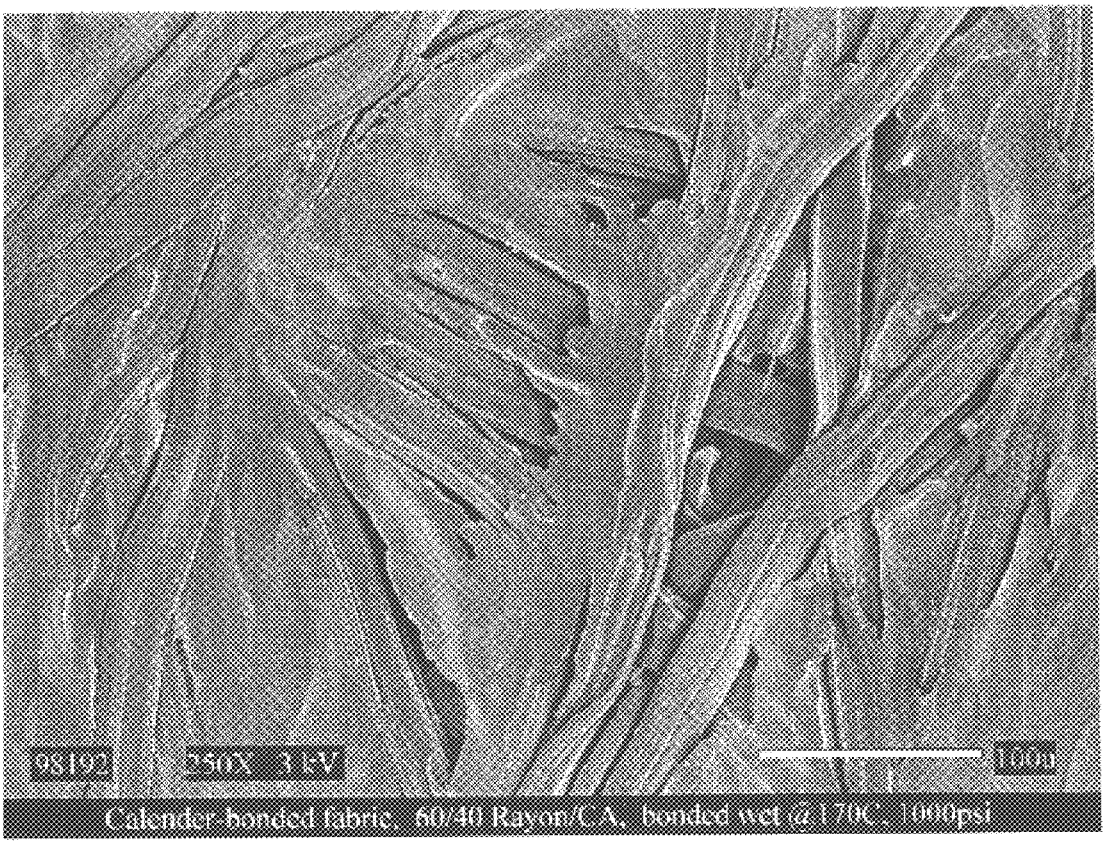
FIG. 3 illustrates the consequences of wet calendering at 170° C. and a pressure of 1000 psi, and further illustrates the amount of acetate flow under these conditions.

FIG. 3 illustrates a 60/40 rayon/CA web wet calender bonded at 170° C. and 1000 psi. The CA fiber in the web has flowed extensively, While such fabric might have limited utility, the results are indicative of the good bonding which can be achieved at this low temperature and at low pressures. Good bonding is expected at very low roller pressures, for example, 20–50 psi. This is commercially advantageous and will allow for the formation of less dense structures.

Figure 4:
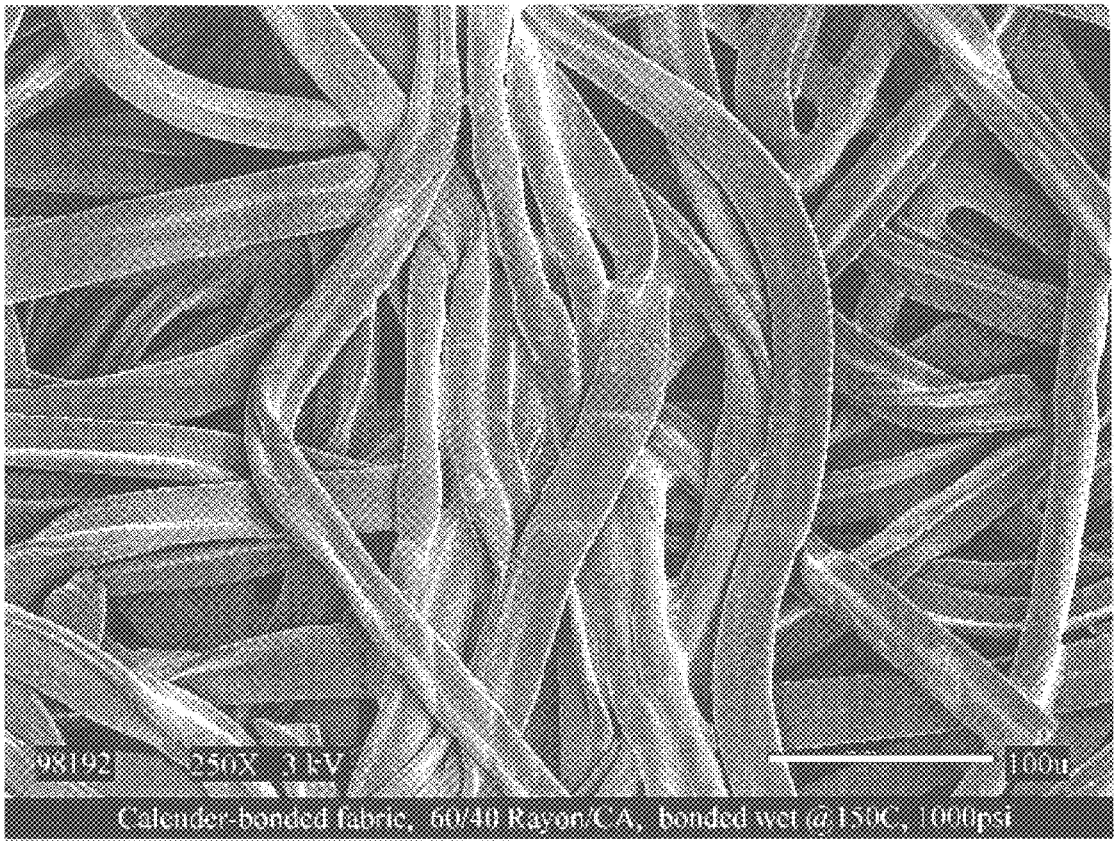
FIG. 4 illustrates that more fiber bonding has occurred in a water wetted fabric after calendering at 150° C. than occurs in a non-wetted fabric that has been calendered at 225° C.

FIG. 4, when compared to FIG. 1, indicates that more bonding occurred at 150° C. with a wetted web than occurred at 225° C. with a non-wetted web.

EXAMPLE 4

Example 4 was carried out to measure the tensile properties of 3 osy card webs of 1 9/16 inch fibers of 100% 1.8 dpf cellulose acetate that were sprayed with water just prior to calendering. Calendering was done between smooth rollers at the temperatures and pressures specified in Table 3. Web material passed between the rollers at a rate of one meter per minute. "None" signifies that the web was not sprayed with water and the moisture content was the normal regain moisture content. Approximately one-half of the water sprayed was applied to each side of the web.

TABLE 4

| | Bonding | | Web Dry | Water Added | | Tensile Properties | |
|---|---|---|---|---|---|---|---|
| Sample | ° C. | psi | Wt. | Wt (g)[3] | %[4] | Peak Load[1] | Strain at Break[2] |
| 4-A1 | 210 | 1000 | 10.30 | None | None | 1.1 | 0.9 |
| 4-A | 210 | 1000 | 7.95 | 1.67 | 20.1 | 3.4 | 1.2 |
| 4-B | 210 | 1000 | 9.02 | 1.88 | 20.8 | 2.9 | 1.1 |
| 4-C | 210 | 1000 | 8.52 | 4.59 | 53.9 | 3.0 | 1.3 |
| 4-D | 210 | 1000 | 9.42 | 9.52 | 100 | ---Untestable[5]--- | |
| 4-N | 190 | 1000 | 8.84 | None | None | 0.8 | 0.9 |
| 4-L | 190 | 1000 | 8.99 | 3.65 | 40.6 | 5.6 | 1.4 |
| 4-M | 190 | 1000 | 7.88 | 7.90 | 100 | 7.6 | 1.1 |
| 4-E | 170 | 1000 | 8.99 | None | None | 0.5 | 0.9 |
| 4-F | 170 | 1000 | 8.29 | 3.36 | 40.5 | 3.8 | 1.6 |
| 4-G | 170 | 1000 | 7.86 | 7.88 | 100 | 9.8 | 1.4 |
| 4-H | 150 | 1000 | 8.97 | None | None | 0.4 | 0.7 |
| 4-I | 150 | 1000 | 8.59 | 1.83 | 21.3 | 0.7 | 3.8 |
| 4- | 150 | 1000 | 8.82 | 3.72 | 42.2 | 2.0 | 1.6 |
| 4-K | 150 | 1000 | 8.42 | 8.42 | 100 | 6.4 | 1.1 |

Notes:
[1]Peak load is in pounds per inch.
[2]Strain at Break is as percentage (%).
[3]Weight of water in the web sample.
[4]Weight % water in wetted sample.
[5]Web 62D became so plastic that it stuck to the hot roller and had to be scraped off.

The data in Table 4 indicates the bonding that is achieved using 100% CA with and without added water. No second type of fiber was present in the web in order to eliminate any complications in interpreting the data due to the second fiber's water adsorption characteristics. The data indicates that there is a noticeable change in the strength of calendered structures when as little as 20% water is present in the structure prior to calendering.

EXAMPLE 5

Example 5 was performed to determine the tensile properties of 2 osy webs of 80% 1.5 dpf rayon and 20% 2.3 dpf CA. The web was formed using ½ inch crennulated-round fibers that were wet laid in water, vacuum extracted to remove excess water and calendered between smooth rollers at the temperatures and pressures indicated in Table 5. Web material was fed to the roller at the rate of one meter per minute.

TABLE 5

| | Calendering | | Tensile properties | |
|---|---|---|---|---|
| Wet Laid Web treatment | ° C. | Pressure | Peak Load | Strain at Break |
| 1. Oven dried at 100° C. before calendering. | 165 | 1000 | Insufficient strength to test. | |
| 2. Calendered without vacuum extraction. | 165 | 1000 | 6.7 | 4.4 |
| 3. Vacuum extracted | 165 | 1000 | 7.9 | 4.0 |

TABLE 5-continued

| Wet Laid Web treatment | Calendering ° C. | Calendering Pressure | Tensile properties Peak Load | Tensile properties Strain at Break |
|---|---|---|---|---|
| and calendered. | | | | |
| 4. Vacuum extracted and air dried for 10 min. before calendering. | 165 | 1000 | 9.2 | 7.5 |
| 5. Vacuum extracted and calendered. | 190 | 1000 | 11.6 | 6.2 |

The data in Table 5 illustrates the physical properties of wet laid web containing rayon and CA. In the absence of water and at a calendering temperature of 165° C., no cohesive strength developed in the web. When water was added to the web, significant strength developed upon calendering. While the amount of water was not measured in Sample 4, it is reasonable to assume that in Sample 4 some of the water content evaporated and that better bonding resulted from a somewhat lowered water content as compared to the samples which were not allowed to air dry. Air drying for 10 minutes, or more, can will reduce the amount of water present in the web. Alternatively, in addition to spraying or dipping the fabric to water wet it, other methods can be used to arrive at an optimum water content for optimum fabric properties at a specified set on bonding temperatures, roller pressure and calender speed. The fabric can be wetted and then passed though a chamber having a specified temperature and moisture content to equilibrate the water content at some specified level. A steam chamber can also be used to wet the fabric.

EXAMPLE 6

A carded web of cellulose triacetate is formed according to method known in the art. The web is comprised of fiber of 2.5 dpf and is of a weight of 3 osy. Samples of the web are calendered dry and after wetting in accordance with the invention. Wetted fabric has a water content of about 200% to about 600% of the dry weight of the fabric in accordance with the invention. Calendering of the wetted samples is done temperatures of 190° C. and roller pressures of 1000 psi. The web is passed through the calendering rollers at a rate of 0.2 meter per minute to bond the triacetate fibers to one another. In contrast, dry triacetate web which contains only normal regain moisture requires a temperature of in the range of 210–280° C. for period of 1–5 minutes, with the addition of tension, to achieve triacetate fiber bonding as indicated in the previously cited *Encyclopedia of Polymer Science and Engineering*, Vol. 6, page 700.

The foregoing examples have been set forth to illustrate the invention are not to taken as limiting the scope or applicability of the invention. Certain changes may be made in carrying out the calendering process set forth herein and in the products form by such process without departing from the scope of the invention. Furthermore, it is to be understood that the following claims are intended to cover all of the generic and specific features of the invention herein described.

What is claimed is:

1. A process for calendering a fabric containing fibers of a cellulose ester and/or a cellulose ether to thereby bond fibers of said cellulose ester/ether present in the fabric to one another and/or to the other fibers present in the fabric which are made of selected substances, said process comprising wetting the fabric and passing the fabric between at least one pair of calendering rollers heated to a temperature of from about 130° C. to about 210° C.; wherein said rollers exert a pressure on the fabric passed there between which is from about 20 psi to about 5000 psi, wherein said fabric is one selected from the group consisting of woven, non-woven and knitted fabrics, and non-woven webs of fibers, and wherein said other fibers are selected from the group consisting of rayon, cotton, wood pulp, flax, hemp and similar substances.

2. The process according to claim 1, wherein the water content of the wetted fabric is from about 20% to about 600% of dry fabric weight.

3. The process according to claim 2, wherein the water content of the wetted fabric is from about 20% to about 200% of dry fabric weight.

4. The process according to claim 2, wherein the roller pressure is from about 20 to about 1000 psi.

5. The process according to claim 4, wherein the roller pressure is from about 50 to about 500 psi.

6. The process according to claim 1, wherein the calendering rollers are heated to a temperature of from about 150° C. to about 190° C.

7. The process according to claim 6, wherein the water content of the wetted fabric is from about 20% to about 600% of dry fabric weight.

8. The process according to claim 7 wherein the water content is from about 20% to about 200% of dry fabric weight.

9. The process according to claim 6, wherein the roller pressure is from about 20 to about 1000 psi.

10. The process according to claim 9, wherein the roller pressure is from about 50 to about 500 psi.

11. The process according to claim 1, wherein the non-cellulose part of the cellulose ester is a $C_5$ or lower alkane or alkene carboxyl acid ester and the non-cellulose part of the cellulose ether is a $C_5$ or lower alkyl or alkenyl group.

12. The process according to claim 11, wherein the cellulose fiber is selected from the group consisting of cellulose acetate and cellulose triacetate.

13. The process according to claim 3, wherein the non-cellulose part of the cellulose ester is a $C_5$ or lower alkane or alkene carboxyl acid ester and the non-cellulose part of the cellulose ether is a $C_5$ or lower alkyl or alkenyl group.

14. The process according to claim 13, wherein the cellulose fiber is selected from the group consisting of cellulose acetate and cellulose triacetate.

15. The process according to claim 4, wherein the non-cellulose part of the cellulose ester is a $C_5$ or lower alkane or alkene carboxyl acid ester and the non-cellulose part of the cellulose ether is a $C_5$ or lower alkyl or alkenyl group.

16. The process according to claim 15, wherein the cellulose fiber is selected from the group consisting of cellulose acetate and cellulose triacetate.

17. The process according to claim 5, wherein the non-cellulose part of the cellulose ester is a $C_5$ or lower alkane or alkene carboxyl acid ester and the non-cellulose part of the cellulose ether is a $C_5$ or lower alkyl or alkenyl group.

18. The process according to claim 17, wherein the cellulose fiber is selected from the group consisting of cellulose acetate and cellulose triacetate.

19. The process according to claim 6, wherein the non-cellulose part of the cellulose ester is a $C_5$ or lower alkane or alkene carboxyl acid ester and the non-cellulose part of the cellulose ether is a $C_5$ or lower alkyl or alkenyl group.

20. The process according to claim 19, wherein the cellulose ester fiber is selected from the group consisting of cellulose acetate and cellulose triacetate.

21. The process according to claim 7, wherein the non-cellulose part of the cellulose ester is a $C_5$ or lower alkane or alkene carboxyl acid ester and the non-cellulose part of the cellulose ether is a $C_5$ or lower alkyl or alkenyl group.

22. The process according to claim 21, wherein the cellulose ester fiber is selected from the group consisting of cellulose acetate and cellulose triacetate.

23. The process according to claim 8, wherein the non-cellulose part of the cellulose ester is a $C_5$ or lower alkane or alkene carboxyl acid ester and the non-cellulose part of the cellulose ether is a $C_5$ or lower alkyl or alkenyl group.

24. The process according to claim 23, wherein the cellulose ester fiber is selected from the group consisting of cellulose acetate and cellulose triacetate.

25. The process according to claim 9 wherein the non-cellulose part of the cellulose ester is a $C_5$ or lower alkane or alkene carboxyl acid ester and the non-cellulose part of the cellulose ether is a $C_5$ or lower alkyl or alkenyl group.

26. The process according to claim 25, wherein the cellulose ester fiber is selected from the group consisting of cellulose acetate and cellulose triacetate.

27. The process according to claim 10, wherein the non-cellulose part of the cellulose ester is a $C_5$ or lower alkane or alkene carboxyl acid ester and the non-cellulose part of the cellulose ether is a $C_5$ or lower alkyl or alkenyl group.

28. The process according to claim 27, wherein the cellulose ester fiber is selected from the group consisting of cellulose acetate and cellulose triacetate.

29. A process for calendering a fabric containing fibers of a cellulose ester and/or a cellulose ether to thereby bond fibers of said cellulose ester/ether present in the fabric to one another and/or to other fibers present in the fabric which are made of selected substances, said process comprising wetting the fabric and passing the fabric between at least one pair of calendering rollers heated to a temperature of from about 150° C. to about 190° C.; wherein said rollers exert a pressure on the fabric passed there between which is from about 500 psi to about 5000 psi, and wherein said fabric is passed between said rollers at a rate of from about 0.3 to about 5 meters per minute, and wherein said fabric is one selected from the group consisting of woven, non-woven and knitted fabrics, and wherein said other fibers are selected from the group consisting of rayon, cotton, wood pulp, flax, hemp and similar substances.

30. The process according to claim 29, wherein the water content of the wetted fabric is from about 20% to about 600% of dry fabric weight.

31. The process according to claim 30, wherein the water content of the wetted fabric is from about 20% to about 200% of dry fabric weight.

32. The process according to claim 29, wherein the roller pressure if from about 500 to about 2500 psi.

33. The process according to claim 32, wherein the roller pressure is from about 1000 to about 2500 psi.

34. The process according to claim 29, wherein the non-cellulose part of the cellulose ester is a $C_5$ or lower alkane or alkene carboxylic acid ester and the non-cellulose part of the cellulose ether is a $C_5$ or lower alkyl or alkenyl group.

35. The process according to claim 34, wherein the cellulose ester fiber is selected from the group consisting of cellulose acetate and cellulose triacetate.

36. The process according to claim 30, wherein the non-cellulose part of the cellulose ester is a $C_5$ or lower alkane or alkene carboxylic acid ester and the non-cellulose part of the cellulose ether is a $C_5$ or lower alkyl or alkenyl group.

37. The process according to claim 36, wherein the cellulose ester fiber is selected from the group consisting of cellulose acetate and cellulose triacetate.

38. The process according to claim 31, wherein the non-cellulose part of the cellulose ester is a $C_5$ or lower alkane or alkene carboxylic acid ester and the non-cellulose part of the cellulose ether is a $C_5$ or lower alkyl or alkenyl group.

39. The process according to claim 38, wherein the cellulose ester fiber is selected from the group consisting of cellulose acetate and cellulose triacetate.

40. The process according to claim 32, wherein the non-cellulose part of the cellulose ester is a $C_5$ or lower alkane or alkene carboxylic acid ester and the non-cellulose part of the cellulose ether is a $C_5$ or lower alkyl or alkenyl group.

41. The process according to claim 40, wherein the cellulose ester fiber is selected from the group consisting of cellulose acetate and cellulose triacetate.

42. The process according to claim 33, wherein the non-cellulose part of the cellulose ester is a $C_5$ or lower alkane or alkene carboxylic acid ester and the non-cellulose part of the cellulose ether is a $C_5$ or lower alkyl or alkenyl group.

43. The process according to claim 42, wherein the cellulose ester fiber is selected from the group consisting of cellulose acetate and cellulose triacetate.

* * * * *